US009707460B1

(12) United States Patent
Sterling

(10) Patent No.: US 9,707,460 B1
(45) Date of Patent: Jul. 18, 2017

(54) ARCADE GAMING DEVICE

(71) Applicant: Monte Quenten Sterling, Bozeman, MT (US)

(72) Inventor: Monte Quenten Sterling, Bozeman, MT (US)

( * ) Notice: Subject to any disclaimer, the term of this patent is extended or adjusted under 35 U.S.C. 154(b) by 0 days.

(21) Appl. No.: 15/260,356

(22) Filed: Sep. 9, 2016

(51) Int. Cl.
*A63B 63/08* (2006.01)
*A63B 67/00* (2006.01)

(52) U.S. Cl.
CPC ..... *A63B 67/002* (2013.01); *A63B 63/08* (2013.01)

(58) Field of Classification Search
CPC ..... A63F 7/02; A63B 67/002; A63B 63/08
See application file for complete search history.

(56) References Cited

U.S. PATENT DOCUMENTS

| | | | | | |
|---|---|---|---|---|---|
| 597,764 | A | | 1/1898 | De Ribas | |
| 1,826,215 | A | | 10/1931 | Hutchison | |
| 2,001,366 | A | * | 5/1935 | Mittelman | A63F 7/02 273/144 R |
| 2,175,971 | A | * | 10/1939 | Perry | A63F 7/02 273/121 B |
| 2,899,206 | A | | 8/1959 | Carter | |
| 3,333,851 | A | * | 8/1967 | Rosen | A63F 7/04 273/110 |
| 3,451,678 | A | | 6/1969 | Gehrts | |
| 3,934,881 | A | * | 1/1976 | Goldfarb | A63F 7/02 273/110 |
| 4,032,148 | A | | 6/1977 | Sanders | |
| 4,153,250 | A | | 5/1979 | Anthony | |
| 4,783,082 | A | * | 11/1988 | Chen | A63F 7/00 273/357 |
| 6,010,130 | A | * | 1/2000 | Schreiber | A63F 7/02 273/118 R |

* cited by examiner

*Primary Examiner* — Michael Dennis
(74) *Attorney, Agent, or Firm* — Louis Ventre, Jr.

(57) ABSTRACT

An arcade gaming device includes a box container with one or more transparent walls and multiple transparent vertical separators that create vertical channels within the box container. Each channel can convey a ball from top to bottom. A movable rack with a handle is slidable by a player to interfere with each ball's downward path. Preferably, the movable rack has projections from it to be used by a player to impact the balls to slow their downward path. Each channel has downwardly sloped planar ramps which slow and convey each ball along a zig-zag or back and forth path within each channel in the box container. The arcade gaming device preferably contains an elevator to move each ball from the bottom of the box container to their drop point, preferably at the top of the box container.

5 Claims, 7 Drawing Sheets

ARCADE GAMING DEVICE

TECHNICAL FIELD

In the field of amusement devices and games, a gravity propelled ball drop arcade game wherein one or more players interact with downward falling balls to alter their time and path to the finish point and wherein the outcome of the game is determined by player interaction affecting which one of a plurality of balls takes the least amount of time to complete, or is first to complete the ball drop course.

BACKGROUND ART

Gravity-powered racing games have been used and described. Typically, such racing games include start and finish positions connected by an inclined, and sometimes circuitous, trackway. Most such prior art describes a continuous track upon which an object races to the bottom. Pinball machines often utilize a single ball interacting with bumpers and targets on a sloped playing field. When player interaction is involved in a game that introduces skill, it typically involves electrically operated push-button paddles that strike the ball to drive it upwards and alter its course, interaction with targets on the course and its travel time. While the general concept of gravity powered games is known, there is still room for a variety of devices that inject a measure of unpredictability, vary the outcome with player interaction, and change the level of human skill involved all while providing entertainment to one or more players.

SUMMARY OF INVENTION

An arcade gaming device includes a box container with one or more transparent walls and multiple transparent vertical separators that create vertical channels within the box container. Each channel is configured so that a ball, dropped at the top of any channel visibly descends through the channel to the bottom of the box container. If there are five channels, then preferably there are five balls, one for each channel. At least one movable rack with a handle is more or less horizontally slidable by a player to interfere with the downward fall of each ball. The slide path of the movable rack is defined by a slotted cutout made in the multiple transparent vertical separators. Preferably, when there is only one movable rack, the slotted cutout, which enables sliding of the movable rack, is located about one-fifth of the way up from the bottom of the box container. The handle to the movable rack extends out of the box container so that the movable rack can be slid back and forth by a player. The movable rack has holes in it to enable each ball to pass through it. Preferably, the movable rack has projections used by a player to impact with the balls and alter their downward path. Each channel has a plurality of planar ramps, which are downwardly sloped so as to slow and convey each ball along a zig-zag or front to back path within each channel in the box container. The arcade gaming device preferably contains an elevator to move each ball from the bottom of the box container to their drop point, preferably at the top of the box container.

Technical Problem

A 3-dimensional action game is needed to permit a timed fall of multiple balls from top to bottom of a transparent box. A game with a non-continuous track is needed to add unpredictability to the travel path. A game is needed where each ball is confined within its own vertical volumetric travel space that is physically separated from the channels for other balls.

A game is needed to permit a player to use manual manipulation of a movable rack to change a ball's falling path and affect its time to the bottom. A game is needed where manual dexterity manipulating the movable rack helps to develop skill in manipulating which ball reaches the bottom first and the order of finish.

Solution to Problem

The solution is an arcade game that marries gravity-powered ball action using non-continuous ramps for ball travel and with player skill to alter the path and time of ball travel.

The solution requires player skill as a necessary factor to change the outcome using a movable rack that permits a player to interfere with the downward path of a ball and thus increase its time from top to bottom.

Advantageous Effects of Invention

This is a new and different arcade game that provides 3-dimensional action in a transparent playfield. It is powered by gravity, yet it is combined with player skill in physically manipulating a movable rack to permit passage of a particular ball or impact the ball to delay its downward travel. Electronic controls may be used for LED lights to brighten the playfield, for added sounds for ball impacts or passages through obstacles, for raising and releasing the balls, and for calculating ball travel times and winners.

BRIEF DESCRIPTION OF DRAWINGS

The drawings illustrate preferred embodiments of the arcade gaming device according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
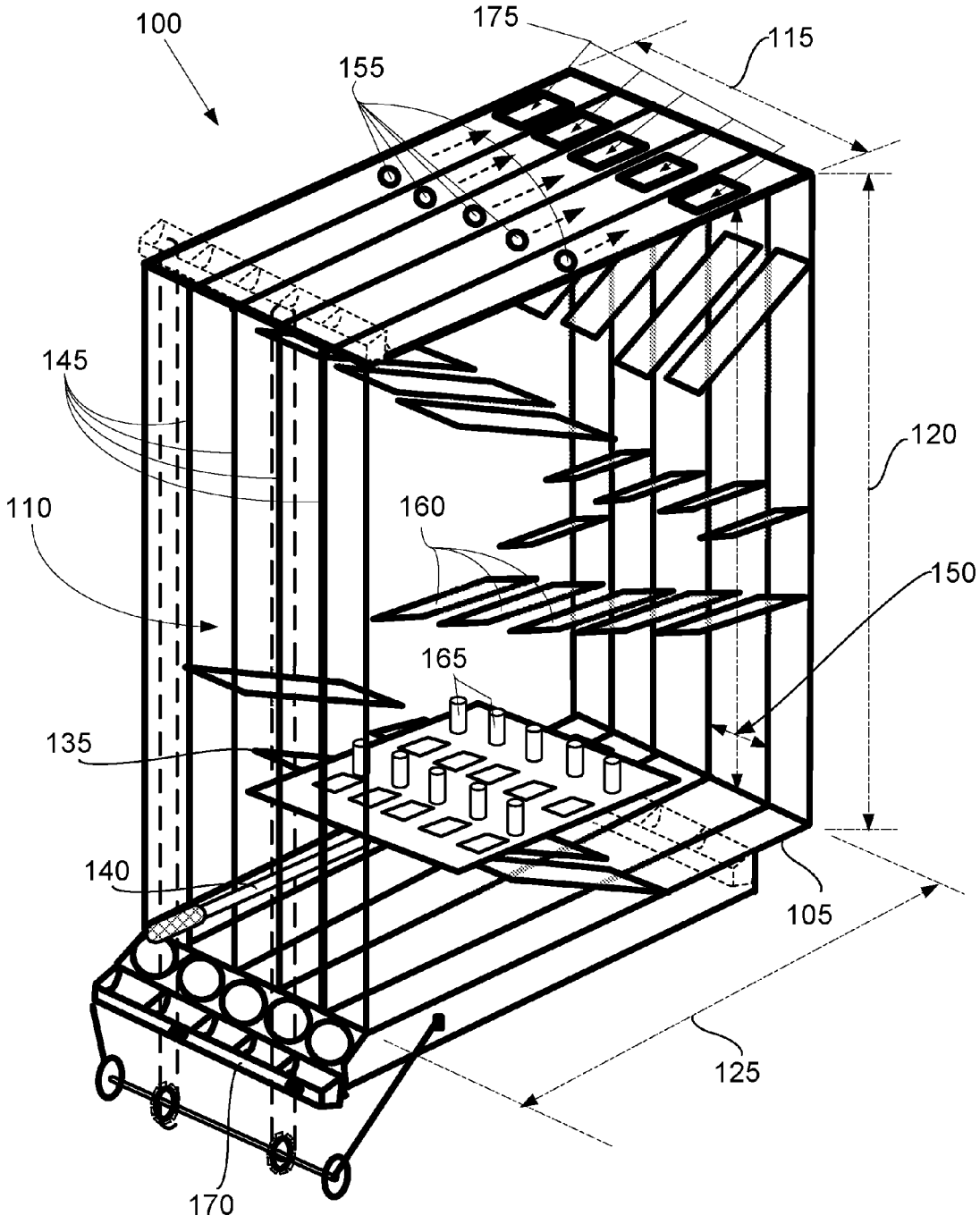
FIG. 1 is a perspective view of an arcade gaming device.

FIG. 1 is a perspective view of an arcade gaming device (100) and it includes a box container (105); a movable rack (305) with a handle (140) and a body (135); a plurality of transparent vertical separators (145) where each transparent vertical separator (405) defines a channel (150); a ball (155) for each channel (150); and a plurality of planar ramps (160).

The box container (105) includes a front transparent box wall (110). Other walls to the box container (105) may also be transparent. For example, in other embodiments, the box container (105) further includes a left-side transparent box wall (215), and a right-side transparent box wall (220).

The box container (105) is defined by a box width (115), a box-rear-wall height (120) and a box depth (125). The box depth (125) is determined by the distance between the front transparent box wall (110) and a rear wall (225). The box-rear-wall height (120) may be shorter than the height of the front transparent box wall (110). This is so that the balls when released at the top of the box container (105) freely roll by gravity to the ball entry port (175). Alternatively, if the box container (105) is cubic, then a ramp may be used at the top to provide the necessary incline for the balls to travel by gravity to the ball entry port (175).

The movable rack (305) includes a body (135) and a handle (140), the body (135) is configured to fit within the box container (105). The handle (140) attached to the body (135) and configured to extend out of the front transparent box wall (110) so as to enable a person to slide the body (135) within the box container (105). Preferably, the movable rack (305) includes projections (165), also referred to as bumpers, extending upward from the body (135) of the movable rack (305). When present, the projections (165) serve as a structure to facilitate impact with a downwardly falling ball (155) as the body (135) of the movable rack (305) is slid by player action within the slotted cutout (205). Sliding the movable rack (305) thus helps to impede and slow the downward path of the ball (155) by imparting a horizontal force vector to any impact with any ball (155) within any channel (150).

The plurality of transparent vertical separators (145) is located within the box container (105). Each transparent vertical separator (405) in the plurality of transparent vertical separators (145) is spaced apart from any transparent vertical separator (405) adjacent to it so as to form a channel (150) within the box container (105). The channel (150) is the playfield for each ball (155) and the playfield must be visible to a player outside the box container (105). Thus, each transparent vertical separator (405) is preferably either glass or PLEXIGLASS.

The channel (150) is also formed between a wall of the box container and any transparent vertical separator (405) adjacent thereto. The channel (150) is the play field for one ball. The channel (150) is vertically oriented and preferably of a uniform width from the top of the box container (105) to the bottom (605) of the box container. Each channel (150) is configured so that any object, such as a ball, within the channel (150) is visible through the front transparent box wall (110). There may be any number of channels: for example there may be 52 channels so that each channel or race field represents one playing card in a deck of cards.

Each ball (155) is preferably a high-bounce ball, which is usually a small rubber ball, somewhat similar to a racquetball. A high-bounce ball provides an energetic bouncing response when the ball impacts one or more of the plurality of planar ramps (160) or one of the projections (165) on the movable rack (305).

Each transparent vertical separator (405) in the plurality of transparent vertical separators (145) is preferably arranged approximately parallel to every other transparent vertical separator (405) in the plurality of transparent vertical separators (145) so that the channel (150) is of a uniform width from top to bottom. The term "approximately" is defined so that the spacing between each transparent vertical separator (405) and either a wall of the box container (105) or another transparent vertical separator (405) is sufficiently wide enough so that it will not trap a ball within the channel (150) or prevent such ball from freely travelling downward within the channel (150).

Figure 2:
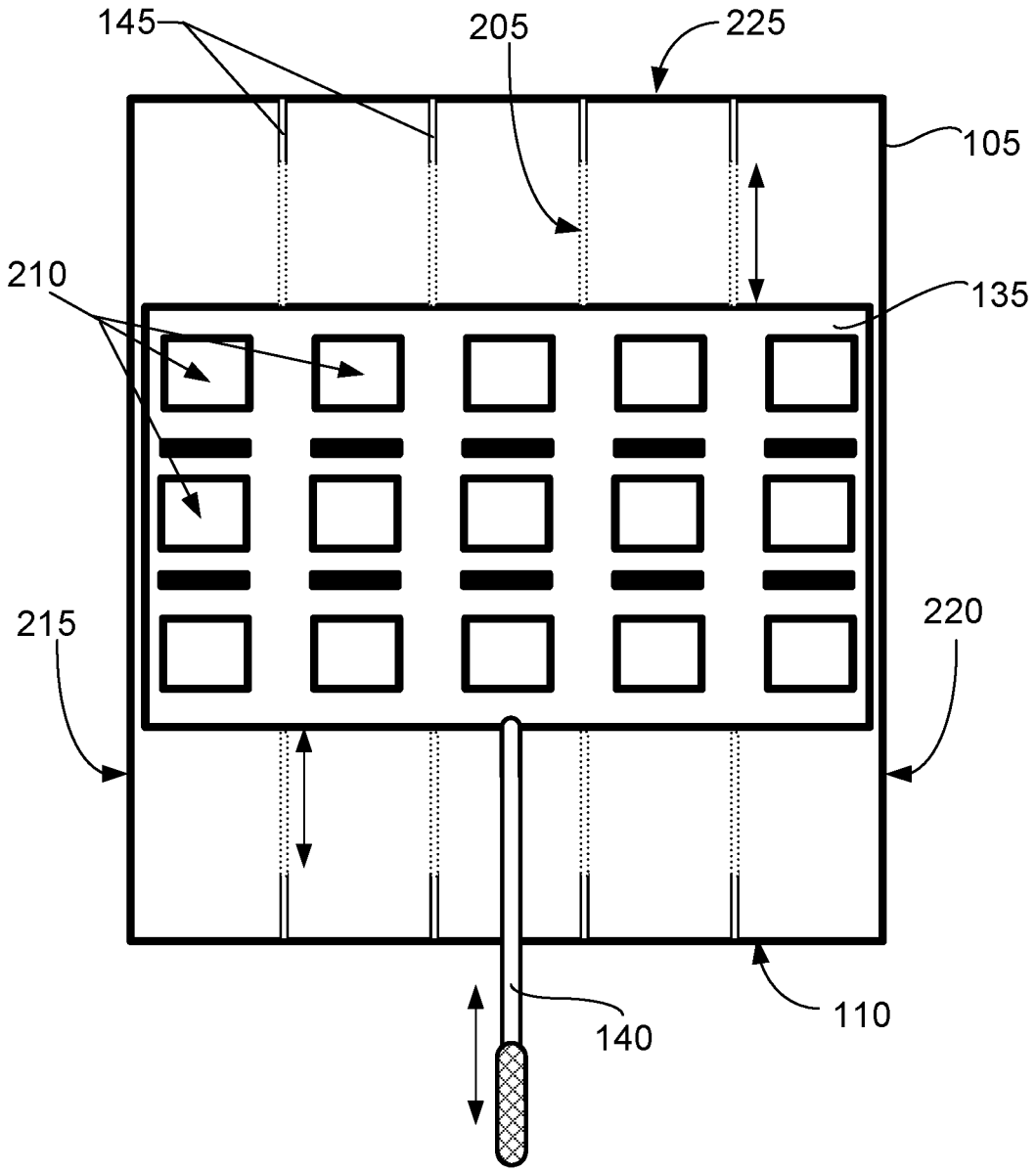
FIG. 2 is a top view of a movable rack within a box container.
Figure 3:
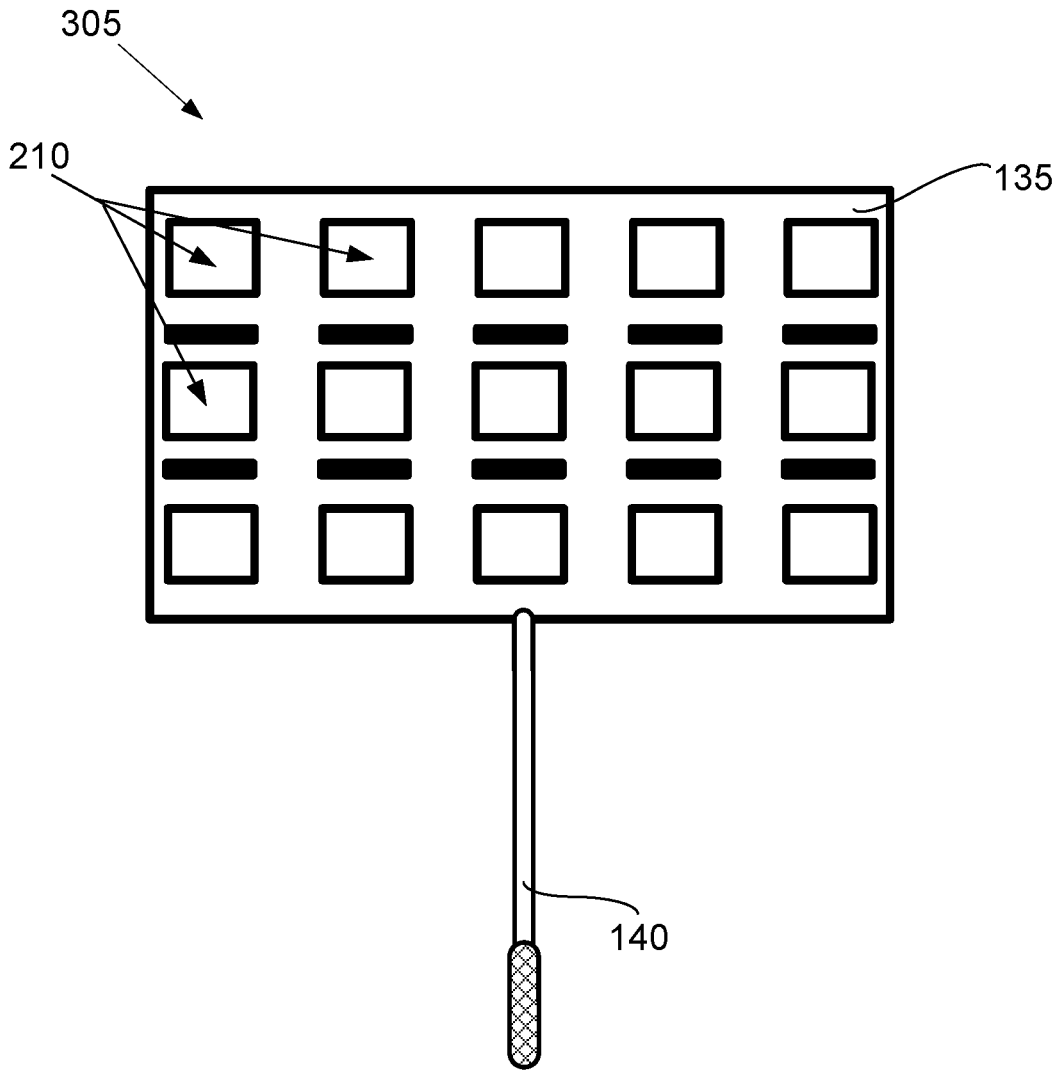
FIG. 3 is a top view of the movable rack showing apertures and projections on the body and the handle.
Figure 4:
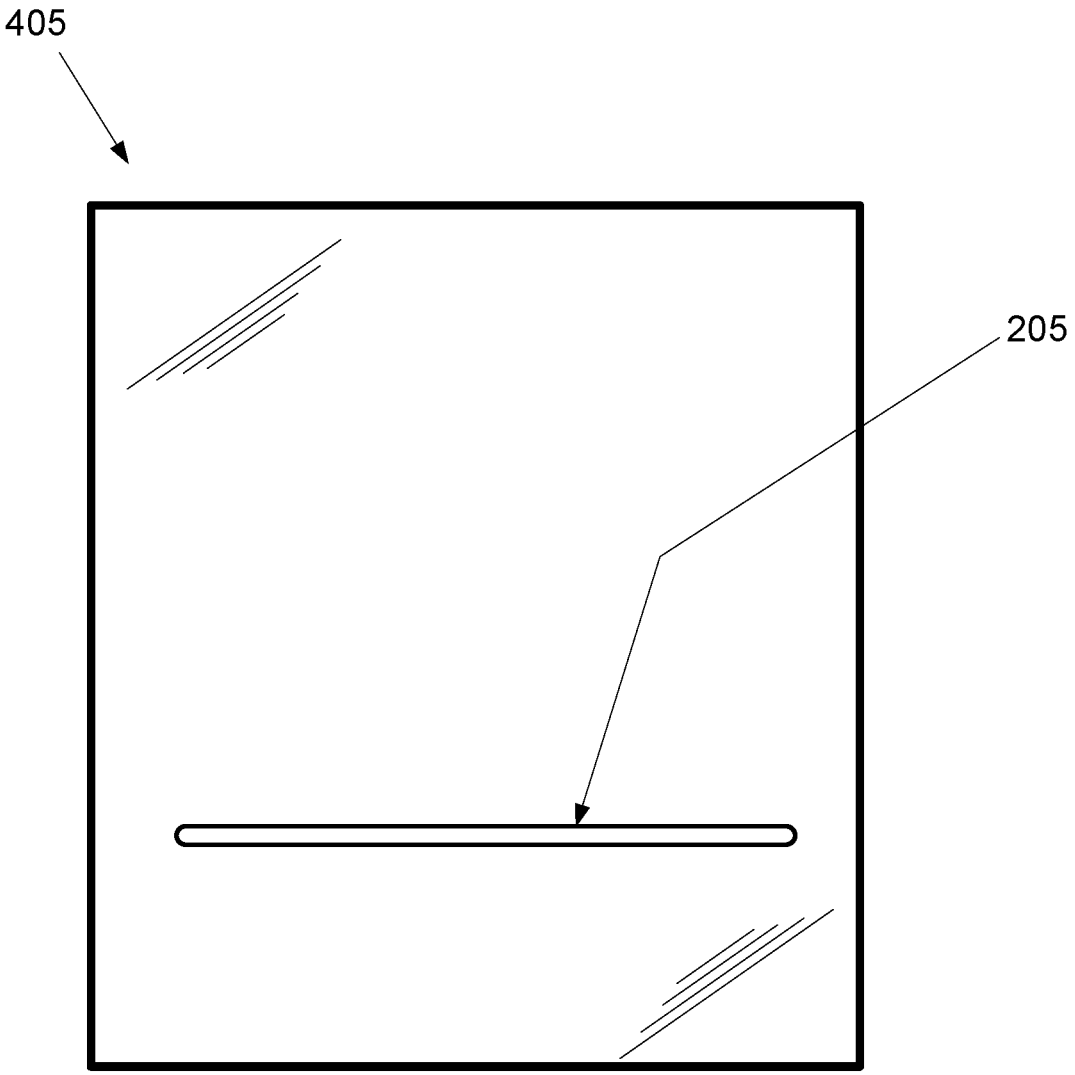
FIG. 4 is a side elevation view of a transparent vertical separator showing the slotted cutout.
Figure 5:
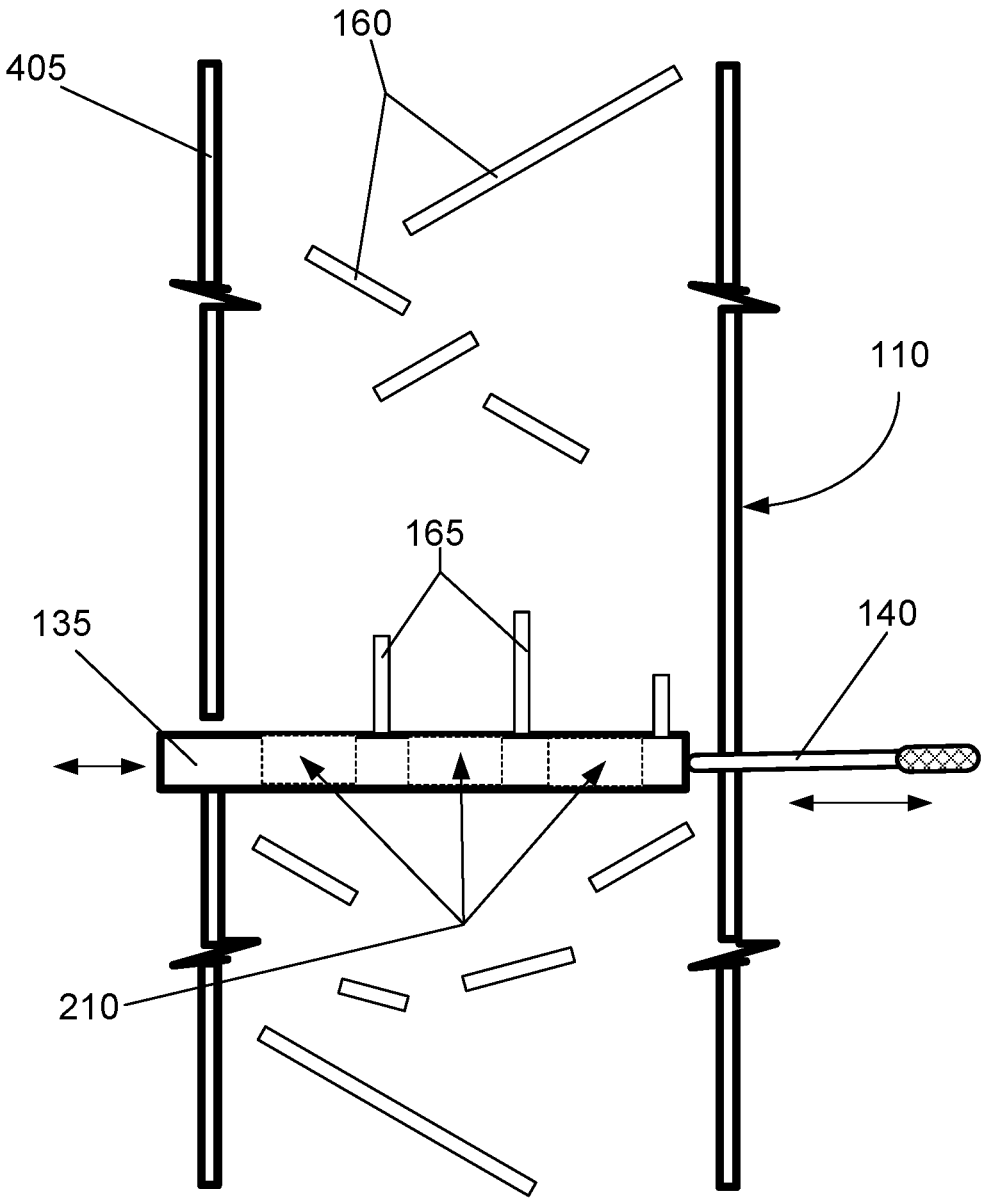
FIG. 5 is a side elevation view showing the front transparent box wall, a transparent vertical separator, planar ramps, and the movable rack with the handle extending outside the front transparent box wall.
Figure 6:
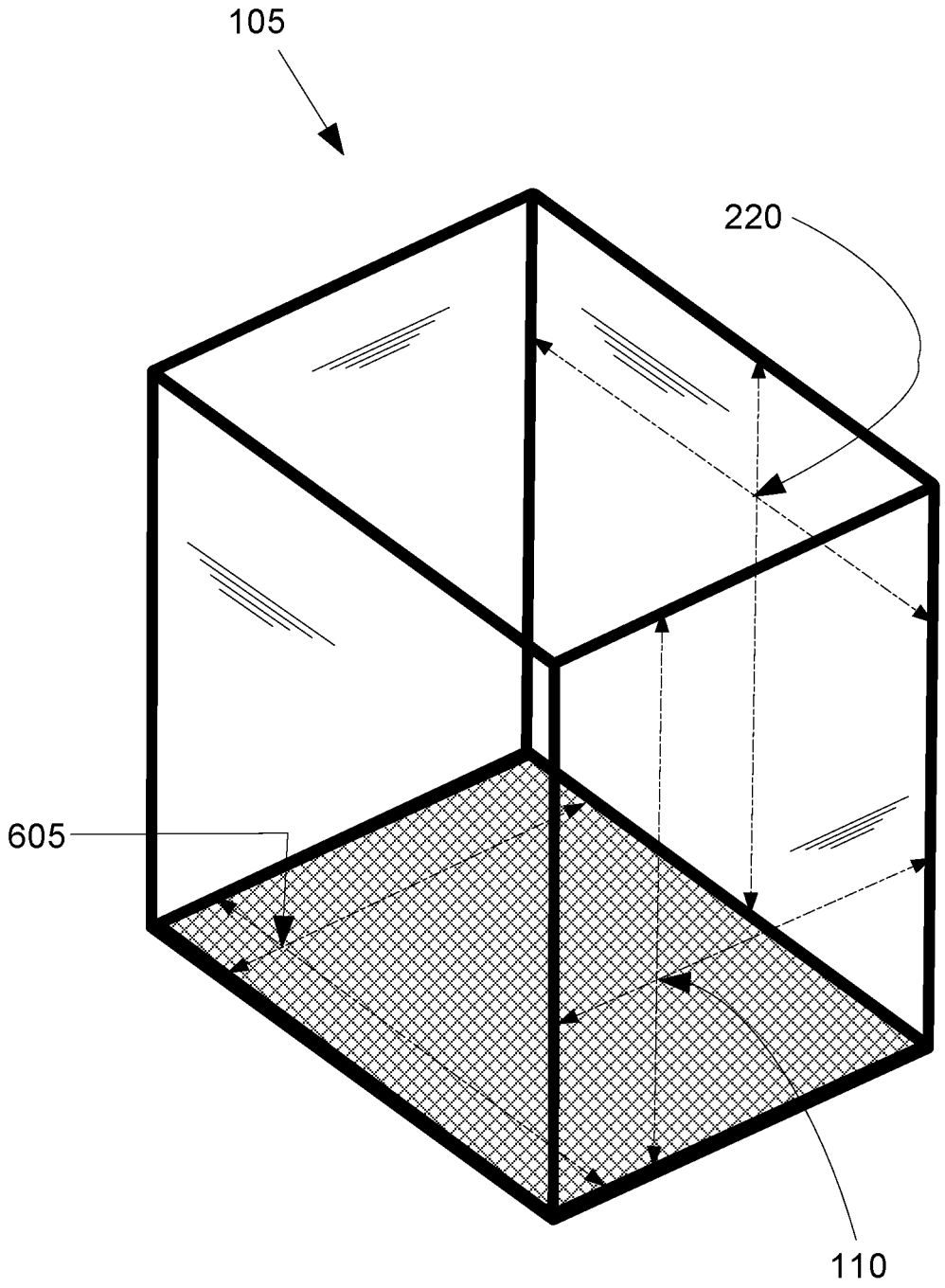
FIG. 6 is a perspective view of a box container.

Each transparent vertical separator (405) defines at least one slotted cutout (205) as shown in FIG. 2. Each slotted cutout is configured to permit the movable rack (305) to slide from a position near the front transparent box wall (110) towards the rear wall (225) of the box container (105) across the plurality of transparent vertical separators (145). Preferably, when the transparent vertical separator (405) defines one slotted cutout (205), that slotted cutout (205) is located about one-fifth of the distance up along the box-rear-wall height (120) from a bottom (605) of the box container (105). This distance up from the bottom is variable and preferably determined based on the convenience of the expected age and height of the player audience.

There is preferably at least one ball (155) for each channel (150). Each ball (155) is sized so as to fall downwardly when the ball (155) is released into the channel (150), preferably from a point near or at the top of the box container (105).

The body (135) of the movable rack (305) has or defines apertures (210) within each channel (150). These apertures (210) are sized to permit the ball (155) falling within the channel (150) to pass through the movable rack (305) on its way to the bottom of the box container (105). A player exercising skill and strategy will manipulate the position of the body (135) to permit a ball to travel through the body (135) or bump it to slow its downward travel.

There is a plurality of planar ramps (160) within each channel (150). Each planar ramp in the plurality of planar ramps (160) is downwardly sloped and configured to slow the downward fall of each ball (155) after the ball (155) is released into the channel (150). The ramps force some horizontal motion to the ball (155), which results in a sort of zig-zag downward path for the ball (155). The planar ramps (160) are preferably configured with a plurality of lengths and downward slopes.

The arcade gaming device (100) may utilize balls that are hand loaded at the top of the box container (105). Preferably, an elevator (170) is included to move each ball (155) from a lower position to a higher position inside the box container (105). The elevator is preferably electrically powered and triggered by the player pushing a start button.

Figure 7:
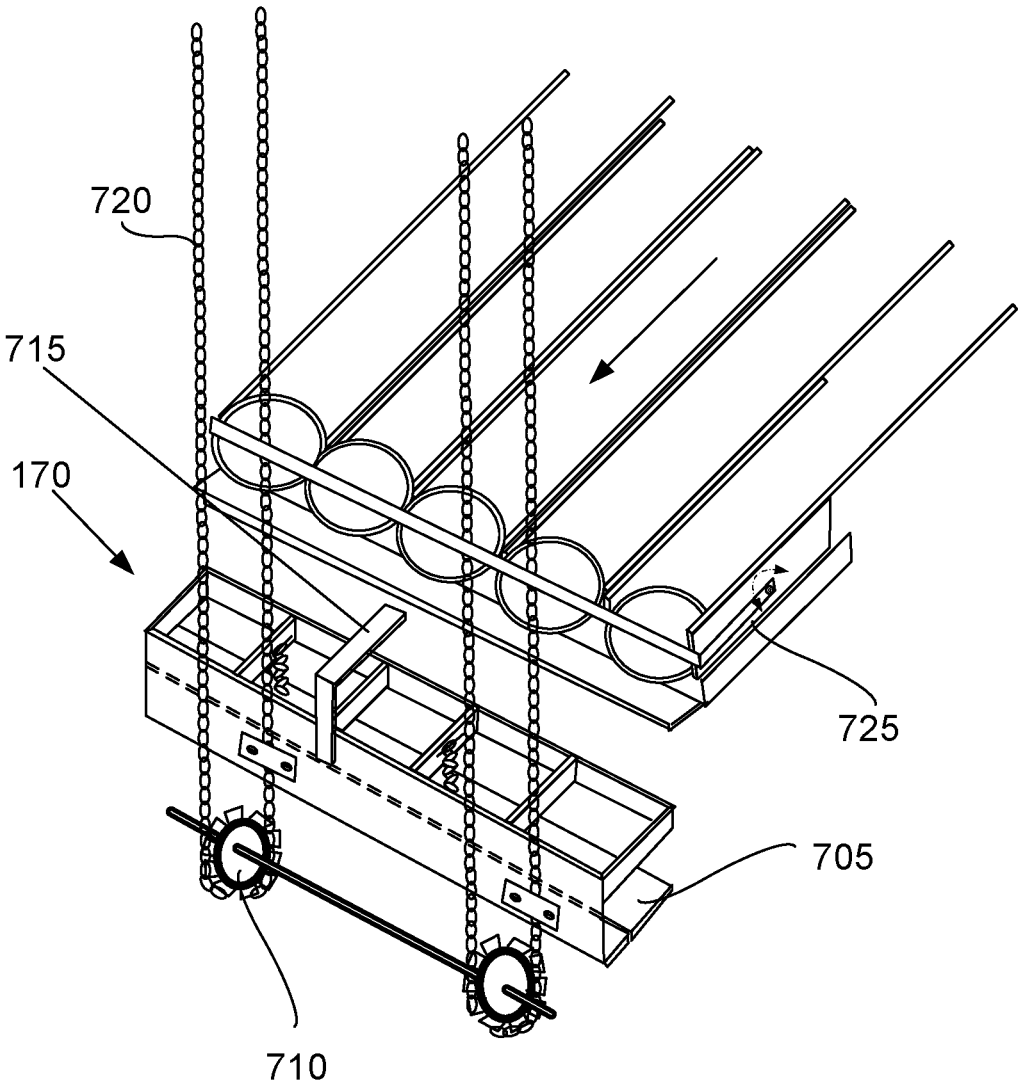
FIG. 7 is a perspective view of a chain-operated elevator.

The elevator (170) shown, in FIG. 1 and FIG. 7, is chain driven, and is but one example of an elevator. The featured elevator includes a hinged bottom door (705) to release the balls; a sprocket (710) that may be manually or motor operated to rotate the chain (720) while raising or lowering the elevator; an opening lever (715) at the bottom of the box container (105) where the balls end up after their journey down from the top of the box container (105); and a drop gate (725) to release the balls into the elevator.

Other types of elevators include a pneumatic system to push the balls upward using compressed air; an electric ramp that raises the balls to the top of the box container using a rack and pinion gear; a belt-driven ball holder; a string lift is used instead of a chain, and a hand lever that is pulled down to raise balls to the top of the box container.

The elevator (170) preferably conveys a plurality of balls from the bottom end point to the top feeding position where one ball (155) per channel is released to fall down though a channel to the bottom (605) of the box container.

EXAMPLE

An arcade game with a 5-channel box container is used to race five super high-bounce balls on a downward course. In this example, all the channels are identical, although the game can be made more difficult by changing lengths and degree of incline of ramps placed within the channel, and having different channel widths combined with varied ball sizes.

In this example, the player selects the order of finish of lanes 1-5. The order of player's press of select buttons 1 through 5 are electronically recorded. The player presses a start button, which activates a solenoid that releases all five balls at the same time, one ball per channel, through a ball entry port at the top of the box container. As the balls roll and bounce on planar ramps, their speeds vary from fast to slow. In this example, the planar ramps are sloped not less than 7 degrees from the horizontal. The player has manual control of a movable rack that is slid back and forth to interact with the downwardly travelling balls. Using skill the player attempts to have one of the balls reach the bottom first. The player's action with the movable rack, thus changes the order of finish for each ball, which is electronically recorded with a switch at the bottom of the playfield. Audio feedback coupled to graphics are provided for heightened awareness of the action of the balls in the playfield. In this example, the player that successfully predicts the order of finish achieves a victory score and flashing lights indicate the achievement level. In this example, redemption tickets are awarded based on the player's score. A ball elevator collects the balls and readies them to be lifted to the top for re-starting the game. The race has a high-level of fun and fascination. The race has a high-level of excitement. The balls exchange the lead multiple times during the course of the race, giving the game a "high play value."

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the gaming industry.

What is claimed is:

1. An arcade gaming device comprising:

a box container comprising a front transparent box wall, the box container defined by a box width, a box-rear-wall height and a box depth, the box depth determined by the distance between the front transparent box wall and a rear wall;

a movable rack comprising a body and a handle, the body configured to fit within the box container, and the handle attached to the body and configured to extend out of the front transparent box wall so as to enable a person to slide the body within the box container;

a plurality of transparent vertical separators within the box container;

each transparent vertical separator in the plurality of transparent vertical separators is spaced apart from any transparent vertical separator adjacent thereto so as to form a channel within the box container, said channel being vertically oriented;

each channel configured so that any object within the channel is visible through the front transparent box wall;

each transparent vertical separator in the plurality of transparent vertical separators is arranged approximately parallel to every other transparent vertical separator in the plurality of transparent vertical separators; and each transparent vertical separator defines at least one slotted cutout configured to permit the movable rack to slide from a position near the front transparent box wall towards the rear wall of the box container across the plurality of transparent vertical separators;

a ball for each channel, each ball sized so as to fall downwardly when said ball is released into the channel;

the body of the movable rack defining apertures within each channel, said apertures sized to permit the ball in said channel to pass through it;

a plurality of planar ramps within each channel, each planar ramp in the plurality of planar ramps is downwardly sloped and configured to slow the downward fall of each said ball after each said ball is released into said channel.

2. The arcade gaming device of claim 1, further comprising projections extending from the body of the movable rack, the projections configured to serve as an impact structure when the body of the movable rack is slid within the slotted cutout to impact with any ball within any channel.

3. The arcade gaming device of claim 1, further comprising an elevator to move each ball from a lower position to a higher position inside the box container.

4. The arcade gaming device of claim 1, wherein the box container further comprises a left-side transparent box wall, and a right-side transparent box wall.

5. The arcade gaming device of claim 1, wherein the transparent vertical separator defines one slotted cutout located about one-fifth of the distance up along the box-rear-wall height from a bottom of the box container.

* * * * *